US007669853B2

(12) United States Patent
Jones

(10) Patent No.: US 7,669,853 B2
(45) Date of Patent: Mar. 2, 2010

(54) CARD SHUFFLING MACHINE

(75) Inventor: Mark H. Jones, Magalia, CA (US)

(73) Assignee: INAG, Inc., Magalia, CA (US)

( * ) Notice: Subject to any disclaimer, the term of this patent is extended or adjusted under 35 U.S.C. 154(b) by 5 days.

(21) Appl. No.: 11/947,202

(22) Filed: Nov. 29, 2007

(65) Prior Publication Data

US 2008/0073842 A1 Mar. 27, 2008

Related U.S. Application Data

(63) Continuation-in-part of application No. 11/468,299, filed on Aug. 29, 2006.

(60) Provisional application No. 60/872,634, filed on Dec. 4, 2006, provisional application No. 60/712,036, filed on Aug. 29, 2005.

(51) Int. Cl.
*A63F 1/00* (2006.01)
*A63F 5/00* (2006.01)

(52) U.S. Cl. ..... 273/149 R; 273/142 JA; 273/142 R; 273/292; 273/274; 463/17; 463/22; 463/40

(58) Field of Classification Search ..... 273/274, 273/149 R, 149 P, 142 JA, 142 R, 142 A, 273/142 B, 142 C, 142 D, 142 E, 142 F, 142 G, 273/142 H, 142 HA, 142 J, 142 JB, 142 JC, 273/142 JD, 292, 293, 304, 142 JR, 143 F, 273/309; 462/22, 17, 31; 463/22, 17, 31, 463/40

See application file for complete search history.

(56) References Cited

U.S. PATENT DOCUMENTS 3,841,637 A * 10/1974 Piazza et al. ..... 273/141 A
3,936,054 A * 2/1976 Garcia ..... 273/243
5,770,533 A * 6/1998 Franchi ..... 463/42
7,165,769 B2 * 1/2007 Crenshaw et al. ..... 273/274

OTHER PUBLICATIONS

Brochure "Rapid Roulette," by ShuffleMaster, Inc., 2 pages.

* cited by examiner

*Primary Examiner*—Benjamin H Layno
(74) *Attorney, Agent, or Firm*—Dickinson Wright PLLC

(57) ABSTRACT

A card shuffling machine (10) includes a turntable (14) in which a plurality of cards (26) rest in respective trays (24). When the turntable (14) is spun, a tongue-like detent (30) resiliently strikes a circular arrangement of peg-like dividers (28) which progressively slows the turntable (14) to a stopped condition. A pointing device singulates one of the cards (26) which can be lifted from its tray (24) and the indicia thereon announced as a game decision. The indicia on the singulated card (26) can be scanned with a machine-readable code and processed through a digital processor (38) to resolve a variety of games played through respective computerized consoles (44).

20 Claims, 6 Drawing Sheets

CARD SHUFFLING MACHINE

This is a continuation in part of U.S. application Ser. No. 11/468,299 filed Aug. 29, 2006, which claims the filing date benefit of U.S. Provisional Application No. 60/712,036 filed Aug. 29, 2005, and further claims the benefit of priority to U.S. Provisional Application No. 60/872,634 filed Dec. 4, 2006.

BACKGROUND OF THE INVENTION

1. Field of the Invention

The invention relates generally to a machine for singulating a card from among a set of cards in a game of chance, and more particularly to a wheel selectively spinnable about a central axis and randomly stopped for selecting one of a plurality of playing cards carried by the wheel.

2. Related Art

A game of chance is a game whose outcome is strongly influenced by some randomizing device, and upon which contestants may or may not wager money as they forecast an outcome. Common randomizing devices include dice, spinning tops, playing cards, roulette wheels, prize wheels, and numbered balls drawn from a container. Playing games of chance have been known throughout all of human history, and is considered to be a popular pastime by many. Players of games of chance are attracted to new and exciting methods of game play, as well as new and exciting randomizing devices. For this reason, the gaming industry is continuously developing new games, and new randomizing devices to maintain player interest and attract new players.

Games of chance that include money wagers are typically regulated by governing authorities. These governing authorities enforce laws and regulations that are enacted to curtail certain kinds of games, as well as certain kinds of randomizing devices. For example, in some jurisdictions the use of dice or roulette wheels to resolve a game outcome, i.e., as the randomizing device, have been curtailed while other randomizing devices such as playing cards are permitted. More frequently, playing cards enjoy a less restrictive use in games of chance played for money, whereas dice and roulette wheel randomizing devices are subject to greater restrictions.

Therefore, there is a desire within the gaming industry to develop new and interesting methods of game play and randomizing devices which utilize playing cards in unique and interesting ways.

SUMMARY OF THE INVENTION

A card shuffling machine is provided for singulating a card from among a set of cards in a game of chance. The shuffling machine comprises a stationary base for establishing a generally vertical central axis. A turntable is movably supported above the base for free rotation within a generally horizontal plane about the central axis. The turntable includes a defined plurality of trays. Each tray is equally circumferentially spaced apart from the other trays about the central axis. The turntable further includes a plurality of dividers. The plurality of dividers are equal in number to the defined plurality of trays, and spaced one from another in equal circumferentially spaced increments about the central axis. A detent is fixed relative to the base and operatively interacts with the dividers. The detent is effective to apply a pulsating resistance to the free rotation of the turntable and thereby progressively slow its rotation to a stopped condition relative to the base. A set of cards are provided, equal in number to the defined plurality of trays. Each card bears an indicia related to a decision for a game of chance. One card is removably disposed in each of the trays. By this machine, a random one of the cards is singulated from the set of cards by progressively slowing the freely rotating turntable to rest through the interference of the detent.

The subject invention thus provides a new and unique randomizing device for playing a game of chance, and more particularly to one which utilizes playing cards.

According to another aspect of this invention, a method is provided for playing a game of chance with the card shuffling machine as described above. The method comprises the steps of providing a bet selection region, making a forecast on the outcome of the game of chance by associating a marker on the bet selection region with at least one of many possible game outcomes. The turntable is accelerated to a maximum rotating speed and then allowed to freely rotate about the central axis. The turntable is progressively slowed and then stopped at a random angular position relative to the base. One of the cards is removed from its respective tray in response to the random angular position of the turntable relative to the base. A game decision is announced based on the indicia of the one card removed from its tray.

Thus, a game of chance played according to the subject invention provides a novel and exciting variation over methods of game play currently available. Furthermore, the subject method is adaptable to a variety of different games.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
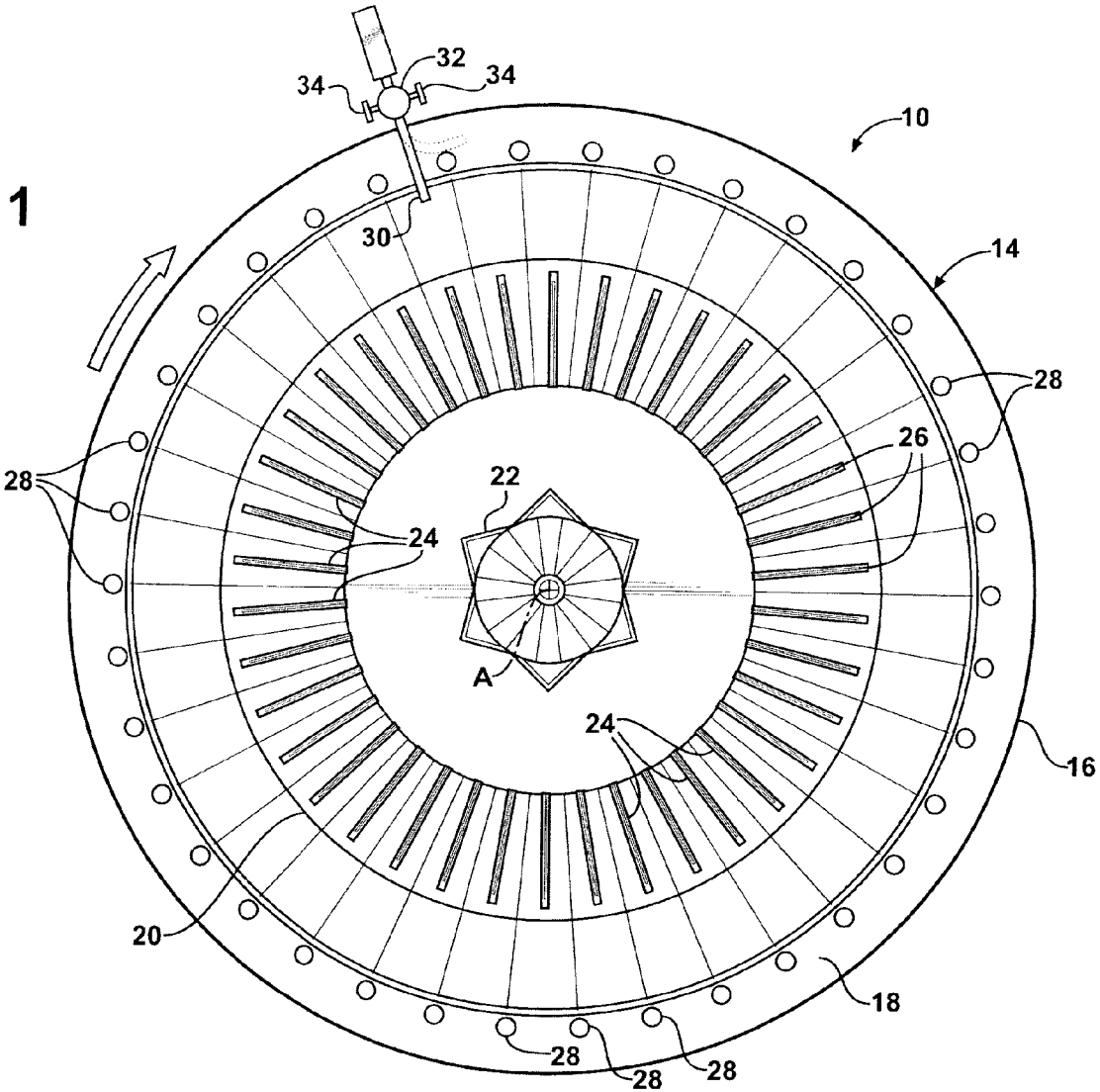
FIG. 1 is a top plan view of a turntable according to the subject invention.
Figure 2:
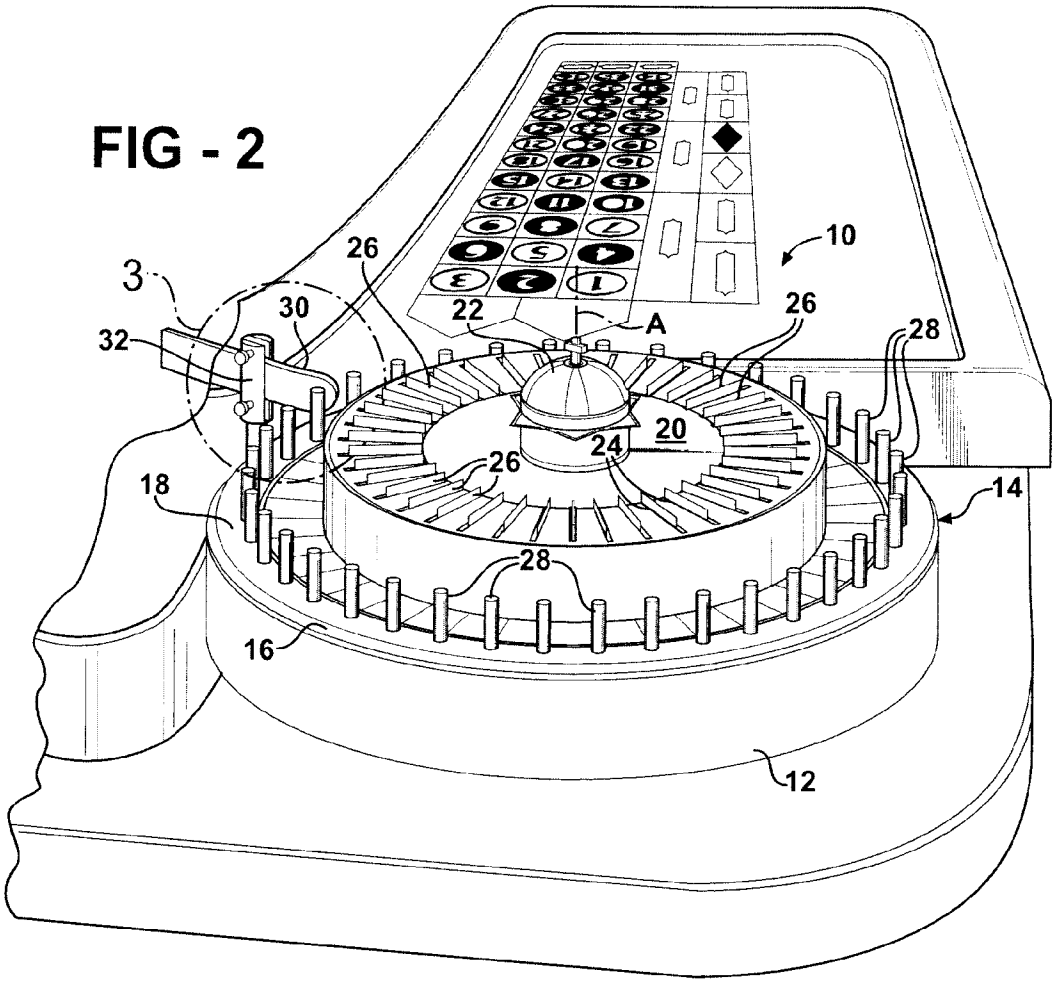
FIG. 2 is a perspective view of one embodiment of this invention, wherein a card shuffling machine is associated with the bet selection region of a conventional roulette style game of chance.
Figure 4:
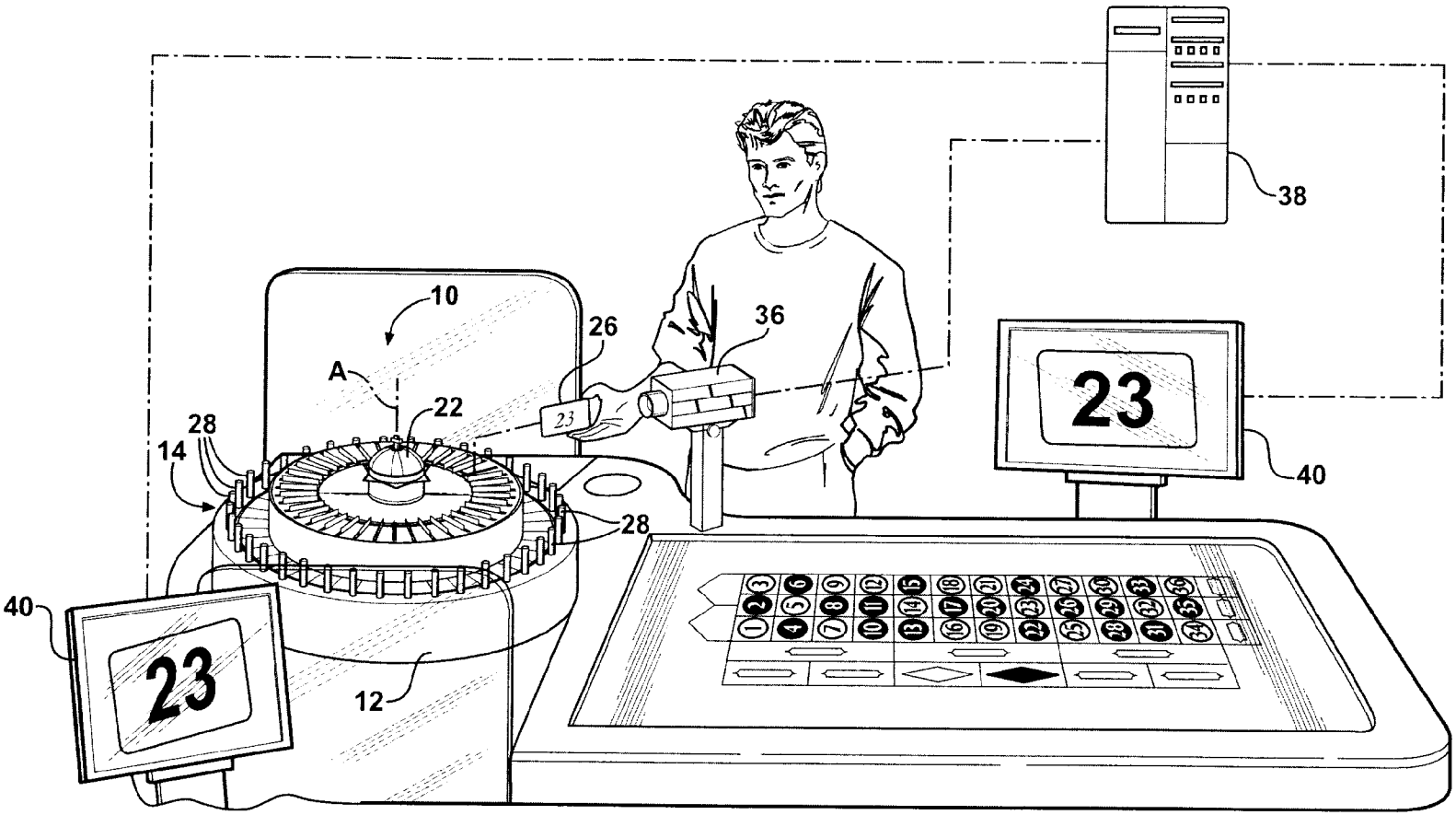
FIG. 4 is a simplified schematic view illustrating an alternative embodiment of the subject invention, wherein a video monitor and video projection device are provided for capturing and displaying the image of the singulated card.

Referring to the Figures, wherein like numerals indicate like or corresponding parts throughout the several views, a card shuffling machine for singulating a card from among a set of cards in a game of chance is generally shown at 10 in FIGS. 1, 2 and 4. As perhaps best shown in FIG. 2, the card machine 10 includes a stationary base 12 which is effective to establish a generally vertical central axis A. In this embodiment of the invention, the base 12 is shown as a squat, generally cylindrical member, however this configuration can be varied to suit taste and application. A turntable 14 is movably supported above the base 12 for free rotation within a generally horizontal plane about the central axis A. The turntable 14 has a generally circular outer periphery 16, and in this embodiment is configured with multiple levels forming a hat-like construction. More specifically, an outer rim section 18 is circumscribed by the outer periphery 16 and rests directly above the stationary base 12. An elevated stage section 20 is centrally located therein. A decorative crown piece 22 is affixed centrally within the stage section 20 for purely aesthetic purposes.

The stage section 20 of the turntable 14 includes a plurality of trays 24. In the exemplary embodiment of this invention depicted in FIG. 1, the defined plurality of trays 24 consists of exactly thirty-eight trays. Depending upon the game of chance to be played, however, the defined plurality of trays 24 can be varied to include more than or less than the exemplary thirty-eight trays illustrated here. The trays 24 are equally circumferentially spaced apart one from another about the central axis A. In other words, in this exemplary embodiment where thirty-eight trays 24 are provided, each tray occupies a sector of approximately 9.47°. If the number of trays 24 were decreased to thirty-six, for example, each tray 24 would occupy a sector of exactly 10°, and so forth. The trays 24 may, as shown in the Figures, comprise narrow slots arranged along radials extending from the central axis A. Each slot is sized, shaped and oriented so as to hold a single playing card 26 in a mentally upstanding orientation.

Figure 6:
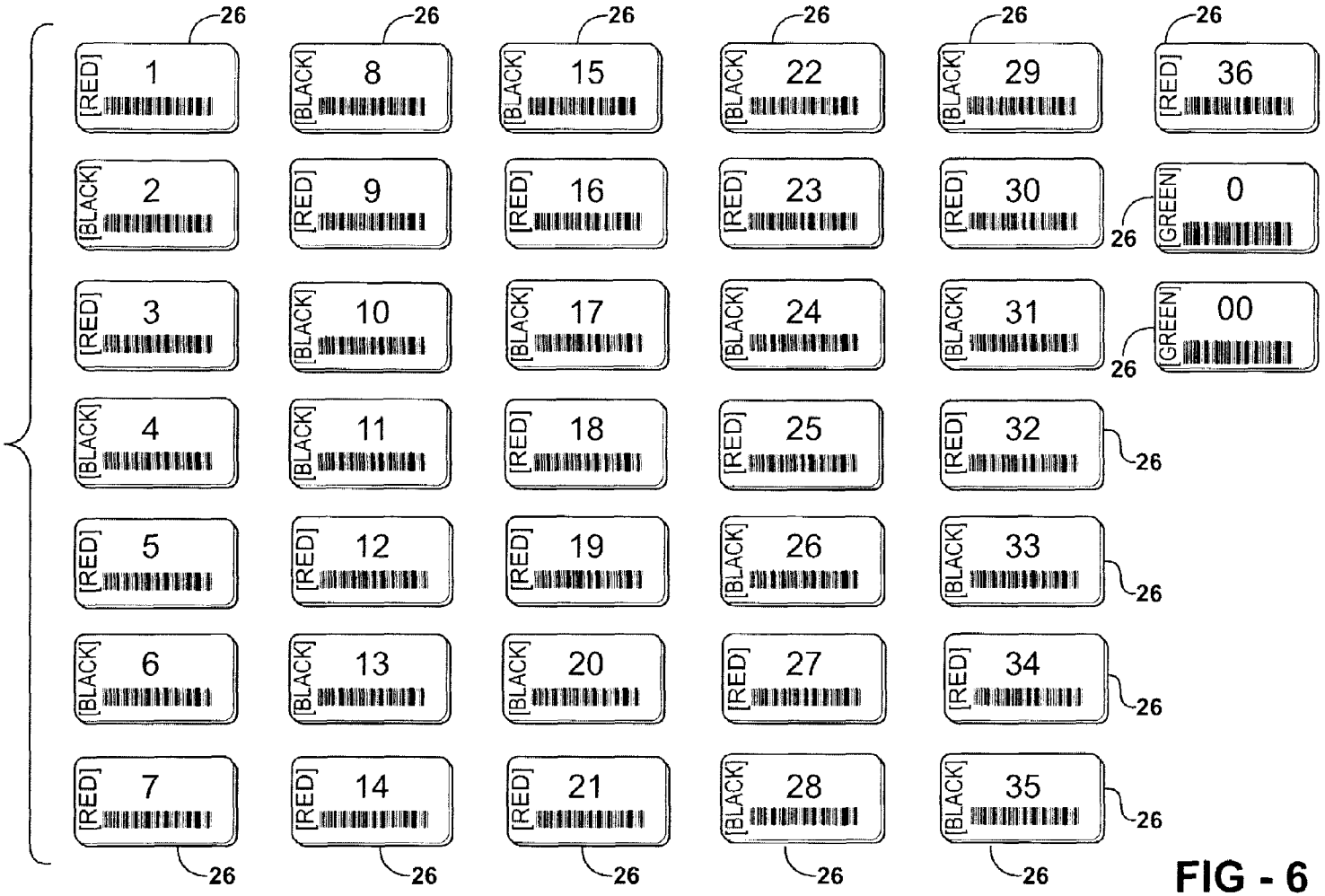
FIG. 6 is an exemplary view of 38 cards as may be used in the subject card shuffling machine for the purpose of playing a game of chance substantially similar to conventional roulette.
Figure 7:
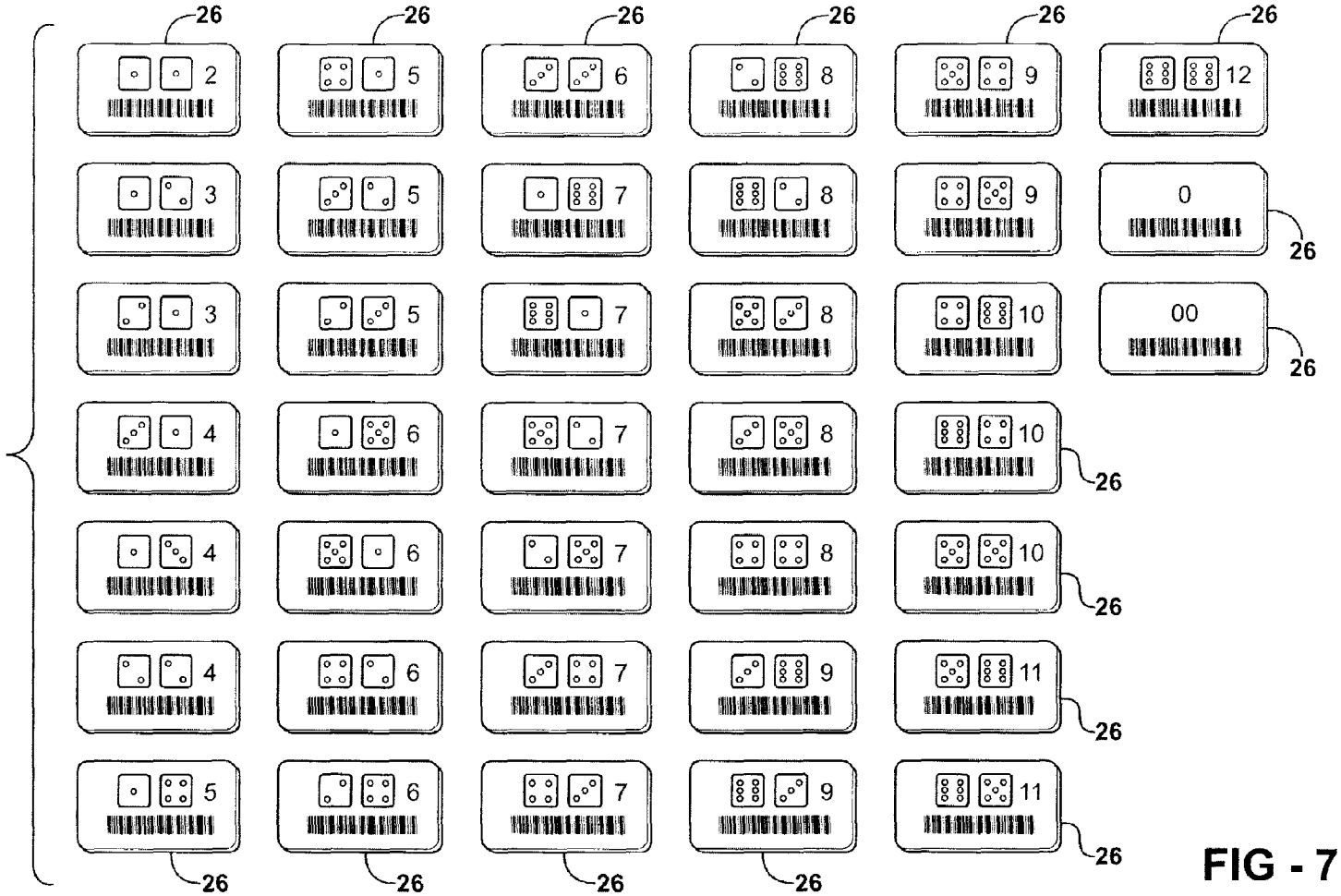
FIG. 7 is a view as in FIG. 6, but illustrating the playing cards having indicia representative of the possible combinations of two six-sided dice for playing a game according to traditional craps.

The card 26 may be dimensionally similar to those used for playing card games like poker, blackjack and the like. Instead of the traditional rectangular configuration, the cards 26 may be shaped in other interesting or effective geometries. A set of cards 26 is equal in number to the defined plurality of trays 24. Thus, in keeping with the previously proposed example of thirty-eight trays 24, a set of cards would consist of thirty-eight distinct cards 26. Reference may be had to FIGS. 6 and 7, wherein mutually exclusive examples of thirty-eight cards 26, each comprising a distinct set of cards, may be found. The trays 24 are arranged so as to hold each card 26 so that its long edges are oriented horizontally, and its short edges are oriented vertically. The depth of each slot in the trays 24 is less than the narrow width of each card 26, so that a noticeable, protruding portion of each card 26 extends above the stage section 20 of the turntable 14. This protruding portion is so that the dealer or operator of a game of chance using the card shuffling machine 10 can easily remove a card 26 from its tray 24. Thus, each card 26 is loosely contained in its respective tray 24 without the use of fastening devices, spring clips, or any other fixation medium.

The rim section 18 of the turntable 14 is provided with a plurality of dividers 28. The plurality of dividers 28 are equal in number to the defined plurality of trays 24. Thus, in the exemplary embodiment where thirty-eight trays 24 are provided, the number of dividers 28 is also thirty-eight. The dividers 28, like the trays 24, are also spaced one from another in equal circumferentially-spaced increments about the central axis A. Thus, if the trays 24 are spaced one from another 9.47°, the dividers 28 are likewise spaced one from another 9.47°. Accordingly, the space between each divider 28, on center line, occupies a sector equal to 9.47°, or whatever arcuate measure is achieved when the number 360 is divided by the number of dividers 28. Preferably, although by no means necessarily, the dividers 28 are oriented so as to perfectly bisect the angular sector between each adjacent tray 24. Said another way, a radial extending from each divider 28 to the central axis A is preferably, but not necessarily, offset from the center-line of each adjacent tray 24 by an angular measure equal to the total number of trays 24 divided by 720. In this manner, the space or gap between each divider 28 may be exclusively associated with one specific tray 24.

A detent 30 is fixed relative to the base 12 and operatively interacts with the dividers 28. The detent 30 functions to apply a pulsating resistance to the free rotation of the turntable 14 and thereby progressively slow the turntable to a stopped condition relative to the base 12. In the exemplary embodiment of this invention as depicted in the drawing Figures, the detent 30 comprises a resiliently flexible tongue supported in a retractable clamping holder 32 so that the tongue 30 can be withdrawn from the movement path of the dividers 28. In this example also, the dividers 28 comprise upstanding pegs which are fixed to the rim section 18 of the turntable 14 at exactly equally radially spaced measurements from the central axis A. Thus, as the turntable 14 is rotated in the direction of the arrow in FIG. 1, the tongue-like detent 30 is moved to a position that interferes with the paths of the dividers 28. When spun forcefully, the angular momentum of the turntable 14 is sufficient to deflect the detent 30 out of the way in a flipper-like fashion typical of prize wheel type randomizing devices known in the prior art. The detent 30 may be made of a felt-like material, or other suitable material. Each sequential impact and deflection of the detent 30 caused by the rotating dividers 28 results in a pulsating resistance which slows the turntable 14 and eventually brings it to a complete stop.

The clamping holder 32 is provided with clamping screws 34 used to tighten or loosen the clamping force upon the detent 30. Preferably, the clamping force is set so that an operator of the card shuffling machine 10 can manually withdraw the detent 30 out of the path of the rotating dividers 28, thereby allowing the turntable 14 to freewheel. When the detent 30 is returned to its position within the path of the moving dividers 28, the detent 30 is operative to frictionally encounter the dividers 28, with each frictional encounter retarding the spin of the turntable 14 until there are enough such encounters to stop the turntable 14. However, those with skill in the art will readily appreciate many alternative detent type mechanisms, both mechanical and electromagnetic, which may be employed to achieve substantially similar results from that of the preferred embodiment just described.

As alluded to previously, each card 26 bears an indicia related to a decision for a game of chance. Almost any of the known games of chance can be played using the card shuffling machine 10 of this invention, so long as the number of cards 26 and the number of their represented indicia result in a probability of decision which is equivalent to the traditionally played game. For example, it is possible to play a game of chance which conforms substantially to the traditional rules of roulette using cards 26 bearing indicia substantially as depicted in FIG. 6. There, it is illustrated that thirty-six cards are marked with distinct indicia selected from the group consisting of the whole numbers 1 to 36. Also in keeping with the traditional rules of roulette, eighteen of the cards may be marked with the color red indicia, while eighteen different cards are marked with the color black indicia. This corresponds to the red and black colors used in traditional roulette. Two additional cards are colored with the green indicia and marked 0 and 00, respectively. When arranged in the trays 24, the card shuffling machine 10 enables any one of these cards 26 to be singulated from the set of cards, and its particular indicia used to decide the game of chance.

In another example, the card shuffling machine 10 of this invention can be used to play a game according to the traditional rules of craps. The randomizing device used in the traditional game of craps consist of a pair of six-sided dice, each side of the dice bearing a dot representative of the whole numbers 1 to 6. Considering the pair of dice together, thirty-six possible combinations can be achieved by the two dice. Accordingly, as shown in FIG. 7, the set of cards 26 may be marked with indicia representing the whole numbers 2 to 12 in the following combinations: one number 2, two number 3's, three number 4's, four number 5's, five number 6's, six number 7's, five number 8's, four number 9's, three number 10's, two number 11's, and one number 12. These cards may also be imprinted with indicia which pictorially represents all thirty-six available combinations of a pair of six-sided dice. When arranged in a turntable 14 consisting of thirty-six equally spaced trays 24, complete odds parity with the traditional game of craps can be achieved through use of the subject card shuffling machine 10. To add variety to the traditional game of craps, one or two additional cards bearing the indicia 0 and 00 can be added. Likewise, other games of chance can be played using the card shuffling machine 10 of this invention as the randomizing device. Such games may include blackjack, war, and many others.

The card shuffling machine 10 must include some type of pointing device, which is fixed relative to the base 12, for indicating one of the plurality of trays 24 when the turntable 14 comes to rest. In the preferred embodiment of this invention, the pointer is integral with the detent 30, in that the tray 24 residing between the dividers 28 on opposite sides of the detent 30, when the turntable 14 comes to rest, will determine which card 26 is to be singulated for the purpose of determining game outcome. Although, a separate and distinct pointer may be used, spaced from the detent 30, to indicate one of the plurality of trays 24 when the turntable 14 stops rotating.

Referring now to FIG. 4, yet another embodiment of this invention is depicted wherein a video capturing device 36 is provided adjacent the turntable 14. In this example, the video capture device 36 may take the form of a video camera or the like. When a dealer or game operator removes the one singulated card 26 from its tray 24, here shown to be the card bearing indicia number "23", the card 26 is presented to the video capture device 36 which routes the image through a digital processor 38, which then transmits the image to one or more video monitors 40. By this method, players of the game of chance can reliably see the indicia of the one singulated card 26 and thereby be assured that the correct game decision has been announced.

Figure 5:
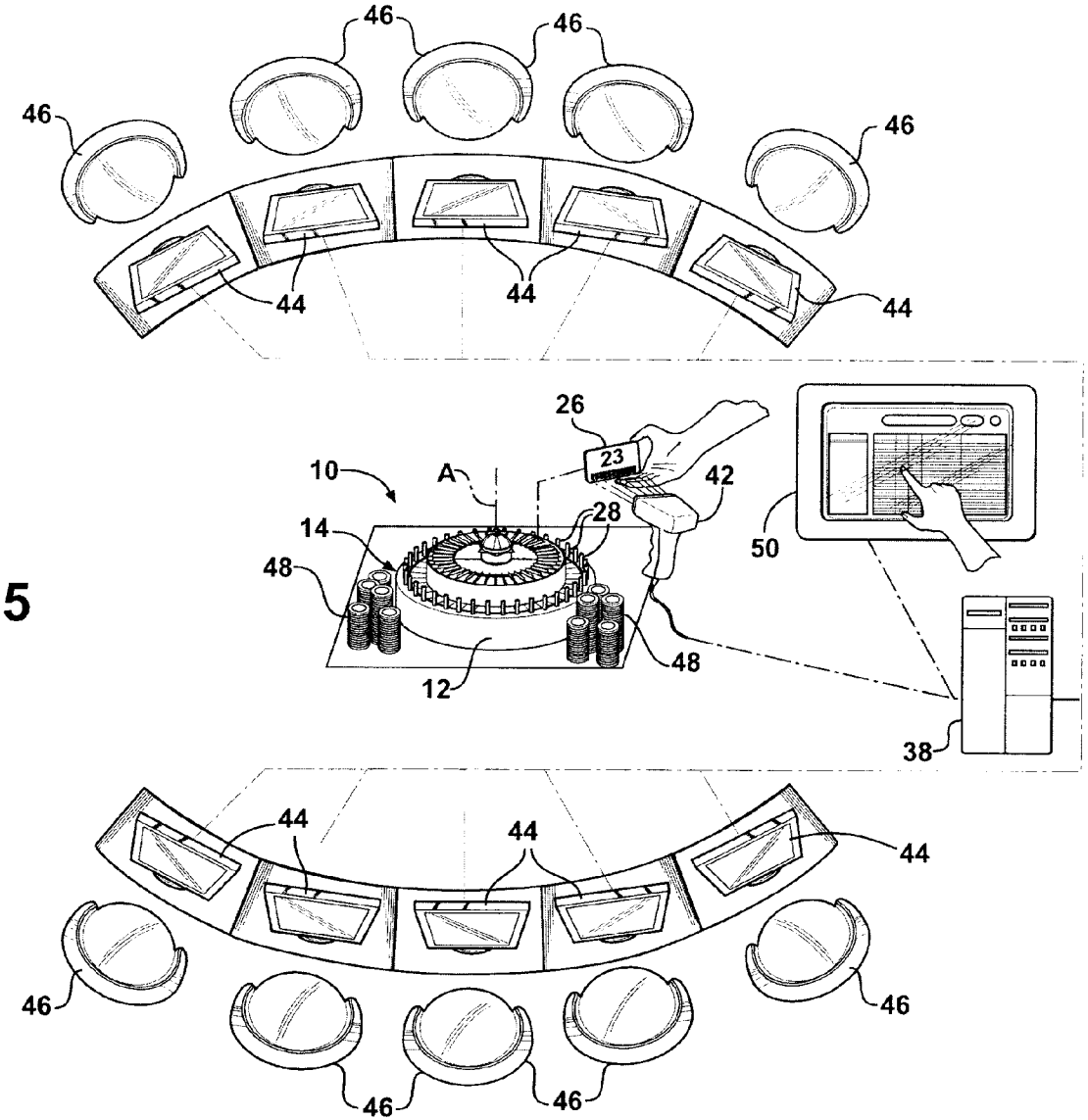
FIG. 5 is a schematic view of yet another alternative embodiment of this invention, wherein a plurality of computerized consoles are operatively connected to a digital processor which in turn is operatively connected to a card reading device for recognizing the indicia of the one singulated card.

In a variation of this technique, the indicia borne on each card 26 may include a machine-readable code such as, for example, a bar code. Instead of the video capture device, the machine may include a card reading device 42 as depicted in FIG. 5. The card reading device 42, here illustrated in the form of a laser scanner, is capable of recognizing the machine readable indicia on the one singulated card 26 and then publishing the identity of the indicia upon a video monitor. In an even more sophisticated extension of this concept, a plurality of such video monitors may be provided in the form of computerized consoles 44. These consoles 44 may be of the touch screen variety commonly known for the casino games of video poker and the like. It is intended that one computerized console 44 would be associated with each individual player of the game of chance. Seats 46 may be arranged directly opposite each computerized console 44. In this embodiment, a bet selection region is projected on to the computerized consoles 44 which, for the example of a roulette type game, may take the graphical appearance of a traditional roulette table. Players make their forecast of the game outcome by associating a marker on the bet selection region of the computer console 44. Many such computerized consoles 44 may be operated simultaneously, and each communicates directly, or indirectly, with a digital processor 38. At the start of each game, each player wagers according to the game rules and makes a forecast on the game outcome. A dealer places the turntable 14 into rotation and, at the appropriate time, engages the detent 30 to progressively slow the turntable 14 to a stop condition. Thereupon, a pointer identifies one tray 24, from which the associated card 26 is withdrawn, i.e., singulated. The dealer then passes the one singulated card 26 in view of the scanner 42, as shown in FIG. 5, causing the digital processor 38 to recognize the game decision and resolve each individual player's game via their computerized consoles 44. In situations where wagers are resolved at each game console 44, as in ticket in-ticket out (TITO) and other such systems, there is no requirement for the dealer or game operator to handle chips, tokens or cheques 48. Nevertheless, in other circumstances it will be necessary for the dealer to oversee a supply of casino cheques 48. The dealer may also be provided with a graphical user interface (GUI) 50 which is shown in FIG. 5 to be of the touch screen variety. Through such a GUI 50, the dealer may effectively administer the game and the wagering process.

Through use of the invention as described here in FIG. 5, electronic posting of the drawn card 26 flows through both a reader board and game processing software to add speed, certainty and enjoyment to the game play. Of course, other card reading formats and card recognition techniques may be employed with, or without, any visible markings on the cards 26. Alternatively, a dealer can manually input the card value, i.e., indicia, manually to the digital processor 38 via the GUI 50.

The turntable 14 can be made conveniently separable from the base 12, so that a different turntable 14 having a different number of trays 24 can be substituted to play different games. Thus, the subject card shuffling machine 10 is readily adaptable from one game method to the next. Although not illustrated in FIG. 1, the sector of the stage section 20 which is occupied by each tray 24 may be colored, for example red or black, to correspond with coloring indicia provided on its associated card 26. Other color and decorative variations may also be imposed depending on taste and application. Furthermore, the overall configuration of the turntable 14 can be varied greatly for stylistic reasons, without departing from the spirit or scope of this invention.

Figure 3:
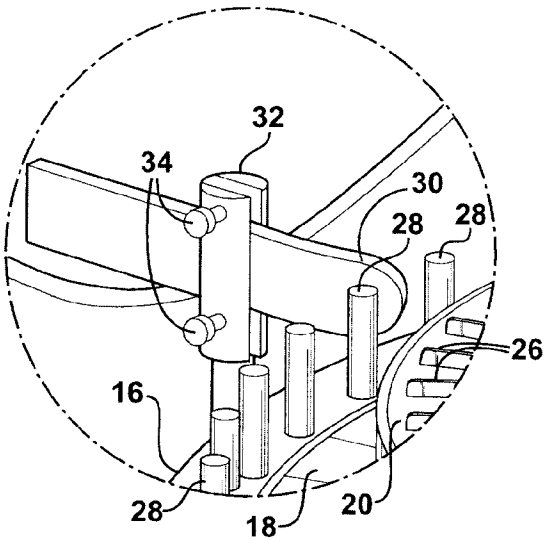
FIG. 3 is an enlarged view of the detent mechanism as depicted by the circumscribed region identified at 3 in FIG. 2.

A method for playing a game of chance using the subject card shuffling machine 10 includes the steps of providing a bet selection region, and then making a forecast on the outcome of a game of chance by associating a marker on the bet selection region with at least one of the many possible game outcomes. As described above, when using the electronically posted version of this invention as illustrated in FIG. 5 together with computerized consoles 44 provided for each individual player, the bet selection region appears as a graphical image on the computerized console 44 and the placing of markers is a purely electronic expression. However, in the version of the invention as illustrated in FIGS. 2 and 3, the bet selection region will comprise a physical game table which is here illustrated as roulette but in other game types will vary accordingly. The placing or associating of markers on the bet selection region with a particular forecast can be done in many ways, but commonly involves placing a chip or other marking device on an available bet selection. Once all bets have been placed, the dealer or game operator accelerates the turntable 14 to a maximum rotating speed by grasping one of the dividers 28 and forcibly spinning the turntable 14. Other techniques can be used including mechanized and motorized rotation. Once a maximum rotating speed has been achieved, the turntable 14 is allowed to freely (i.e., without power input) rotate about its central axis A. Left to its own devices through the natural frictional resistance in the underlying bearing mechanisms, the turntable 14 will gradually slow to a stop. However, to hasten the game decision, the detent 30 is slid, rotated or otherwise moved into an active position wherein the resiliently bendable tongue, fixed relative to the base 12, encounters each peg-like divider 28 individually, with each frictional encounter retarding the spin of the wheel until there have been enough such encounters to stop the turntable 14. Thus, the turntable 14 is progressively slowed and stopped at a random angular position relative to the base 14. The detent 30 itself, or separate pointing device, is used to identify one of the plurality of trays 24. The card 24 associated with that one tray 24 is then removed from its slot and a game decision is announced based on the indicia borne on that one card 24. The announcing step may include projecting a video image of the card 26 or, in a more sophisticated embodiment, scanning a machine-readable code on the card 26.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A card shuffling machine for singulating a card from among a set of cards in a game of chance, said machine comprising:

a stationary base for establishing a generally vertical central axis;

a turntable moveably supported above said base for free rotation within a generally horizontal plane about said central axis;

said turntable including a defined plurality of trays, said trays equally circumferentially spaced apart one from another about said central axis, each said tray including a radially outermost stop;

said turntable further including a plurality of dividers, said plurality of dividers being equal in number to said defined plurality of trays and spaced one from another in equal circumferentially-spaced increments about said central axis;

a detent fixed relative to said base and operatively interactive with said dividers, said detent effective to apply a pulsating resistance to free rotation of said turntable and thereby progressively slow said turntable to a stopped condition relative to said base;

a set of cards equal in number to said defined plurality of trays, each said card bearing an indicia related to a decision for a game of chance; and one said card removably disposed in each of said trays, whereby by a random one of said cards is singulated from said set of cards by progressively slowing a free rotating said turntable to rest through the interference of said detent.

2. The card shuffling machine according to claim 1 wherein said detent includes a resiliently flexible tongue.

3. The card shuffling machine according to claim 2 wherein each said divider includes a peg.

4. The card shuffling machine according to claim 1 wherein said detent includes a retractable clamping holder for allowing said detent to be selectively withdrawn from the movement path of said dividers.

5. The card shuffling machine according to claim 1 further including at least one video monitor and a video capture device for capturing an image of said one singulated card and displaying said image on said monitor.

6. The card shuffling machine according to claim 1 further including at least one video monitor and a card reading device for recognizing the indicia of said one singulated card and publishing the identity of said indicia on said monitor.

7. The card shuffling machine according to claim 6 wherein said indicia of said cards includes a machine-readable code, and said card reading device comprises a scanner for converting said machine-readable code to a digital image, and further including a digital processor operatively disposed between said scanner and said monitor.

8. The card shuffling machine according to claim 7 wherein said at least one video monitor comprises a plurality of computerized consoles operatively connected to said digital processor and simultaneously updated with the identity of said indicia on said one singulated card.

9. The card shuffling machine according to claim 8 further including a graphic user interface operatively connected to said digital processor.

10. The card shuffling machine according to claim 1 including a pointer fixed relative to said base for indicating one of said plurality of trays.

11. The card shuffling machine according to claim 10 wherein said pointer is integral with said detent.

12. A card shuffling machine for singulating a card from among a set of cards in a game of chance, said machine comprising:

a stationary base for establishing a generally vertical central axis;

a turntable moveably supported above said base for free rotation within a generally horizontal plane about said central axis;

said turntable including a defined plurality of trays, said trays equally circumferentially spaced apart one from another about said central axis, each said tray including a radially outermost stop;

said turntable further including a plurality of pegs, said plurality of pegs being equal in number to said defined plurality of trays and spaced one from another in equal circumferentially-spaced increments about said central axis;

a resiliently flexible tongue fixed relative to said base and operatively interactive with said pegs, said tongue effective to apply a pulsating resistance to free rotation of said turntable and thereby progressively slow said turntable to a stopped condition relative to said base;

a set of cards equal in number to said defined plurality of trays, each said card bearing an indicia related to a decision for a game of chance; and one said card removably disposed in each of said trays, whereby by a random one of said cards is singulated from said set of cards by progressively slowing a free rotating said turntable to rest through the interference of said tongue against said pegs.

13. The card shuffling machine according to claim 12 wherein said set of cards including at least thirty-six cards each marked with distinct indicia selected from the group consisting of the whole numbers 1 to 36.

14. A card shuffling machine according to claim 13 wherein said set of cards including at least eighteen cards marked with the color red indicia and at least eighteen different cards marked with the color black indicia.

15. A card shuffling machine according to claim 12 wherein said set of cards including at least thirty-six cards each marked with indicia representing the whole numbers 2 to 12 in the following combinations: one number 2, two number 3's, three number 4's, four number 5's, five number 6's, six number 7's, five number 8's, four number 9's, three number 10's, two number 11's, and one number 12.

16. A method for playing a game of chance with a rotary card shuffling machine, said method comprising the steps of:

providing a stationary base for establishing a generally vertical central axis;

moveably supporting a turntable above the base for free rotation within a generally horizontal plane about the central axis;

forming a plurality of trays in the turntable that are equally circumferentially spaced apart one from another about the central axis, each tray having a radially outermost stop;

providing a set of cards equal in number to the plurality of trays, each card bearing an indicia related to a decision for a game of chance;

removably disposing one card in a respective tray adjacent its stop;

providing a bet selection region;

making a forecast on the outcome of said game of chance by associating a marker on the bet selection region with at least one of many possible game outcomes;

accelerating the turntable to a maximum rotating speed with the cards retained in their respective trays against the influence of centrifugal forces by the stop at the radially outermost portion of the trays and then allowing the turntable to freely rotate about the central axis;

progressively slowing the free rotating turntable;

stopping the turntable at a random angular position relative to the base;

removing at least one card from its respective tray in response to the random angular position of the turntable relative to the base; and announcing a game decision based on the indicia of the at least one card removed from its tray.

17. The method for playing a game of chance according to claim 16 wherein said step of announcing a game decision including displaying an image of the one card removed from its tray on a video monitor.

18. The method for playing a game of chance according to claim 16 wherein following said step of removing one card from its respective tray, further including the step of scanning a machine-readable code on the one card and converting that code to a digital image.

19. The method for playing a game of chance according to claim 18 further including the step of operatively connecting a plurality of computerized consoles to a digital processor, said step of providing a bet selection region including providing a bet selection region on each console, and said step of making a forecast including associating a marker on the bet selection region of each console.

20. The method for playing a game of chance according to claim 19 wherein said step of announcing a game decision includes simultaneously updating each console with the identity of the indicia on the one singulated card.

* * * * *